US010149520B2

(12) United States Patent
Mace

(10) Patent No.: US 10,149,520 B2
(45) Date of Patent: Dec. 11, 2018

(54) ATTACHMENT DEVICE

(71) Applicant: Montres Breguet S.A., L'Abbaye (CH)

(72) Inventor: Jerome Mace, Le Pont (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/784,631

(22) Filed: Oct. 16, 2017

(65) Prior Publication Data

US 2018/0125180 A1 May 10, 2018

(30) Foreign Application Priority Data

Nov. 4, 2016 (EP) ..... 16197192

(51) Int. Cl.

| | |
|---|---|
| ***A44C 5/18*** | (2006.01) |
| ***A44C 5/14*** | (2006.01) |
| *E05D 7/10* | (2006.01) |

(52) U.S. Cl.

CPC ..... *A44C 5/185* (2013.01); *A44C 5/145* (2013.01); *A44D 2201/06* (2013.01); *E05D 7/1077* (2013.01); *Y10T 16/53615* (2015.01); *Y10T 24/2155* (2015.01); *Y10T 24/4782* (2015.01)

(58) Field of Classification Search

CPC ..... Y10T 24/4782; Y10T 16/53615; Y10T 24/4718; Y10T 24/2155; E05D 7/1077; E05D 7/12; A44C 5/185

USPC ..... 63/7, 3.1, 21; 16/254, 260, 267

See application file for complete search history.

(56) References Cited

U.S. PATENT DOCUMENTS

| | | | | |
|---|---|---|---|---|
| 1,774,468 A | | 8/1930 | Bernard | |
| 2,315,801 A | * | 4/1943 | Lave | B61D 17/10 105/375 |
| 2,618,809 A | * | 11/1952 | Rubinoff | E05D 7/1066 16/267 |
| 2,732,581 A | * | 1/1956 | Heck | E05D 5/10 16/224 |

(Continued)

FOREIGN PATENT DOCUMENTS

| | | |
|---|---|---|
| DE | 526 470 | 6/1931 |
| EP | 0 461 069 A1 | 12/1991 |

(Continued)

OTHER PUBLICATIONS

European Search Report dated Mar. 6, 2017 in European Application 16197192.4, filed on Nov. 4, 2016 (with English Translation of Categories of cited documents).

*Primary Examiner* — Robert Sandy
*Assistant Examiner* — Michael S Lee
(74) *Attorney, Agent, or Firm* — Oblon, McClelland, Maier & Neustadt, L.L.P.

(57) ABSTRACT

An attachment device is provided for two elements of a watch band to allow the two elements to be hooked into place or unhooked. The first element includes at least one bar on one of its ends. The second element includes two grooves, each including a longitudinal opening respectively opposite one another, and one of the two elements can move from an unhooked position. One of the elements is oriented in a predetermined angular position in relation to the other element, to a hooked position, in which the two elements are coplanar after a rotation of a predetermined angle of one of the two elements in relation to the other so that each groove is articulated on the bar to hold the two elements hooked to one another.

15 Claims, 2 Drawing Sheets

(56) References Cited

U.S. PATENT DOCUMENTS

| | | | | | |
|---|---|---|---|---|---|
| 3,091,357 | A * | 5/1963 | Weinhart | A45C 13/005 | 16/260 |
| 3,126,120 | A * | 3/1964 | Crate | E05D 5/10 | 16/267 |
| 5,158,219 | A | 10/1992 | Baumgartner et al. | | |
| 5,455,987 | A * | 10/1995 | Svehaug | E05D 7/1072 | 16/267 |
| 5,647,518 | A | 7/1997 | Baumgartner et al. | | |
| 6,461,026 | B1 * | 10/2002 | Wang | F21V 17/107 | 16/267 |
| 8,887,354 | B1 * | 11/2014 | Weinman | E05D 7/12 | 16/252 |
| 2007/0289095 | A1 * | 12/2007 | Wagner | E05D 7/12 | 16/267 |

FOREIGN PATENT DOCUMENTS

| | | | |
|---|---|---|---|
| EP | 0 683 993 | A1 | 11/1995 |
| FR | 2 265 297 | A1 | 10/1975 |
| WO | WO 2016/004922 | A1 | 1/2016 |

* cited by examiner

ATTACHMENT DEVICE

This application claims priority from European Patent Application No. 16197192.4 filed on Nov. 4, 2016; the entire disclosure of which is incorporated herein by reference

FIELD OF THE INVENTION

The invention relates to the field of attachment devices, and more specifically to attachment devices for timepieces to attach a strand to a case or a clasp to a strand.

The invention also relates to an attachment device for a leather wristband or jewellery bracelet.

BACKGROUND OF THE INVENTION

Classically, the device for attaching a wristband to a case or a clasp is configured in the form of a bar or a pin. The pin must be attached or detached by means of a tool to be able to remove the wristband from the watch, for example, or to be able to change the clasp.

It is desirable to be able to separate the wristband into two parts to make the attachment/detachment of the wristband on the case and/or the clasp on the wristband easier.

In the prior art wristbands or clasps require the use of tools to be able to attach and/or detach the wristband and clasp, which is not practical for the user when he/she wishes to change the wristband or clasp.

SUMMARY OF THE INVENTION

An object of the present invention is to remedy all or some of the disadvantages mentioned above by providing an attachment device that allows a quick attachment/detachment, in particular without requiring use of a tool.

Another object of the invention, at least in a particular embodiment, is to provide an attachment device that is easy to use and inexpensive.

For this purpose, the invention relates to an attachment device for two elements of a watch band to allow said two elements to be hooked into place or unhooked, wherein the first element comprises at least one bar on one of its ends.

According to the invention the second element comprises two fixed grooves, each comprising a longitudinal opening respectively opposite one another, and one of the two elements can move from an unhooked position, in which one of the elements is oriented in a predetermined angular position in relation to the other element, to a hooked position, in which the two elements are coplanar after a rotation of a predetermined angle of one of the two elements in relation to the other so that each groove is articulated on the bar to hold the two elements hooked to one another.

Because of these characteristics, such an attachment device enables a clasp to be attached and detached easily and quickly to/from a wristband strand, for example.

In accordance with other advantageous variants of the invention:

- the dimension of the longitudinal opening of the grooves is slightly smaller than the bar;
- the grooves comprise a straight cylindrical slot, the diameter of which is slightly larger than the diameter of the bar;
- the first element comprises a central element surrounding the bar;
- the second element comprises a free space arranged between the two grooves and arranged to receive said central element of the first element;

- the predetermined angular position is in the range of between 45° and 90°;
- the second element is made in a single block.

BRIEF DESCRIPTION OF THE DRAWINGS

Other characteristics and advantages of the invention will become clearer on reading the following description of a particular embodiment of the invention given as non-restrictive illustrative example and of the attached drawings, wherein.

DETAILED DESCRIPTION OF PREFERRED EMBODIMENTS

An attachment device according to the invention will now be described in the following with reference to FIGS. 1 and 2*a* to 2*d* in combination.

Figure 1:
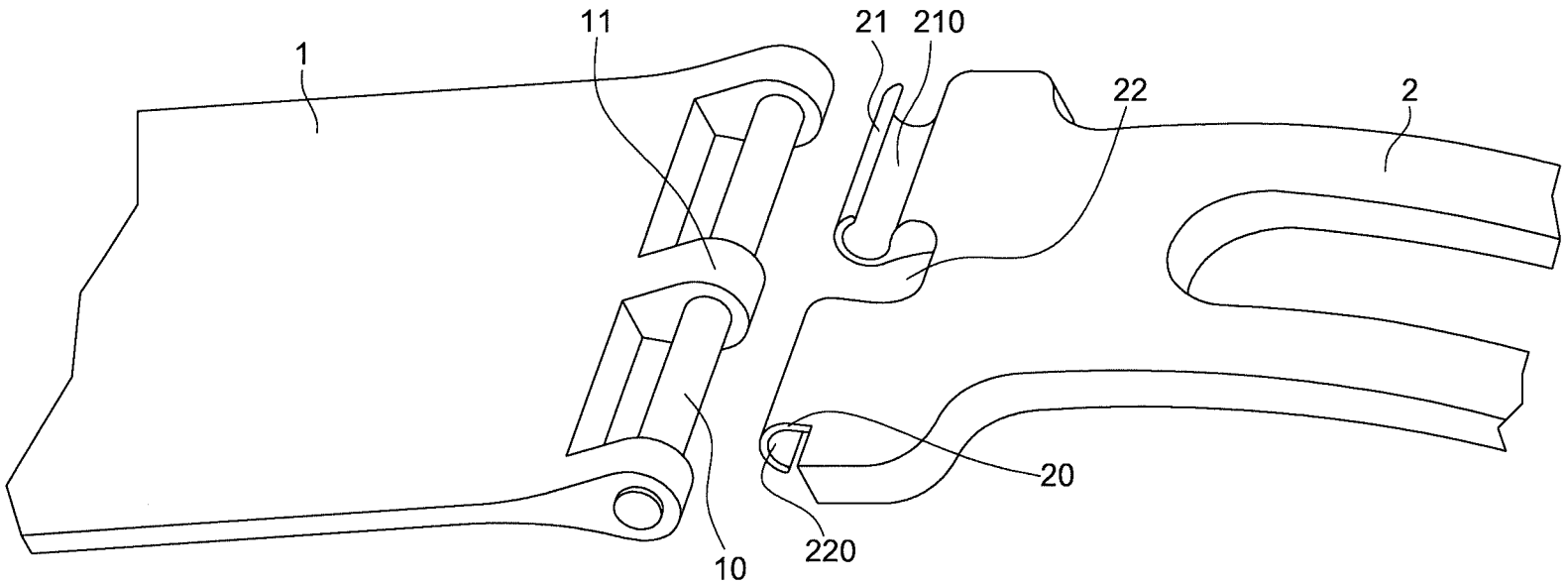
FIG. 1 is a perspective view of a device of the invention according to a first embodiment.

As illustrated in FIG. 1, the attachment device comprises two elements 1 and 2 of a watch band to enable the two elements 1,2 to be hooked in place or unhooked. As can be seen, the first element 1 comprises at least one bar 10 at one of its ends. The two elements 1, 2 can consist of a wristband strand for the first element and a clasp for the second element, for example.

The second element 2 comprises two fixed grooves 20, 21, each comprising a longitudinal opening 210, 220 respectively opposite one another. Advantageously, the second element 2 is formed from a single block.

According to the invention one of the two elements can move from an unhooked position, in which one of the two elements is oriented in a predetermined angular position in relation to the other element, to a hooked position, in which the two elements 1, 2 are coplanar after a rotation of a predetermined angle of one of the two elements in relation to the other so that each groove is articulated on the bar 10 to hold the two elements 1, 2 hooked to one another.

Preferably, one of the two elements is positioned perpendicularly in relation to the other, wherein one of the elements is in the transverse plane and the other in the sagittal plane. Thus, the rotation of one of the two elements is in the range of between 0° and 90°, and more preferred between 45° and 90°. The rotation can be conducted in clockwise or anticlockwise direction, depending on the orientation of the grooves 20, 21.

Advantageously, the dimensions of the respective longitudinal openings 210, 220 of the grooves 20, 21 are slightly smaller than the bar 10 in order to prevent any untimely detachment, and the opening has a width slightly smaller than the diameter of the bar 10. Thus, during placement of the grooves 20, 21 on the bar 10, the user must use a light force to insert the bar 10 and hear a "click" signifying that the grooves 20, 21 have been properly positioned on the bar 10.

As can be seen in FIG. 1, the grooves 20 and 21 each comprise a straight cylindrical slot, into which the longitudinal openings 210, 220 open, wherein the diameter of the slot is provided to be slightly larger than the diameter of the bar 10 to limit friction and facilitate the rotation during the pivoting of one element in relation to the other. However, the diameter of the slot should not be too much larger to prevent too great a play that would be uncomfortable for the wearer.

As can be seen in FIG. 1, the first element comprises a central element 11 surrounding the bar 10, and the second element 2 comprises a free space 22 arranged between the two grooves 20, 21 and arranged to receive the central element 11 of the first element 1. The two grooves 20, 21 are distant from one another and define a space 22 between them that is arranged to receive the central element 11 during positioning of the first element with the second element.

According to the invention such an attachment device can be used equally well for a flexible wristband made from leather, textile or a plastic material to attach the wristband to a case or to a clasp or as for attaching a linked wristband to a clasp.

FIGS. 2*a* to 2*d* illustrate the different stages for assembly of the two elements 1 and 2.

Figure 2A:
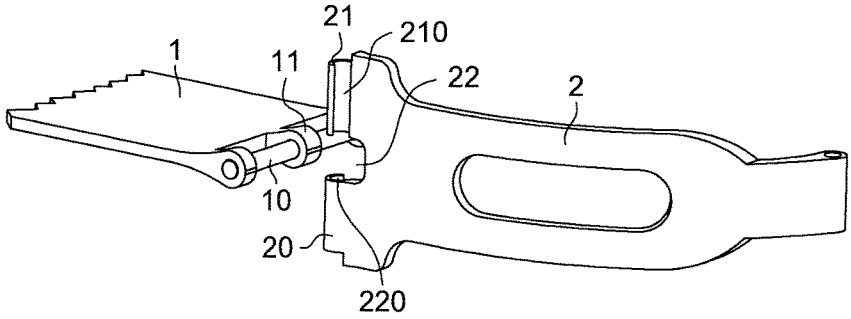
FIGS. 2*a* to 2*d* illustrate the different stages for using a device according to the invention.
Figure 2B:
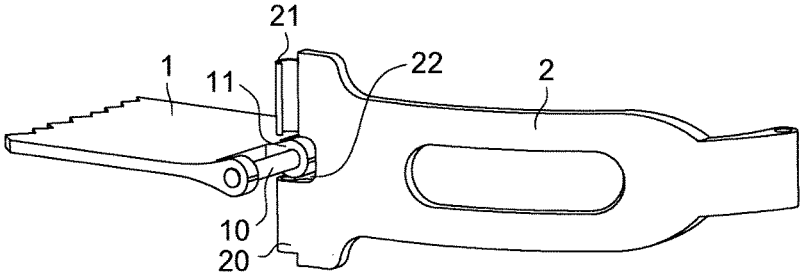
Figure 2C:
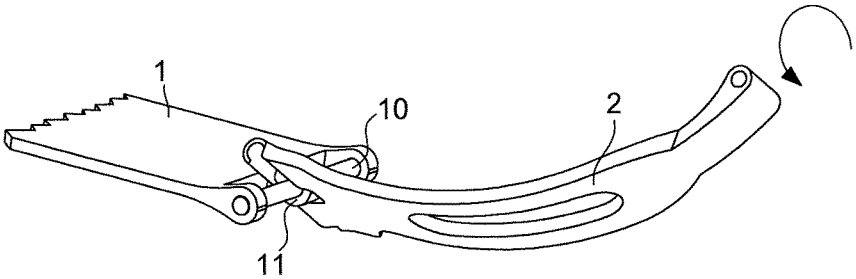
Figure 2D:
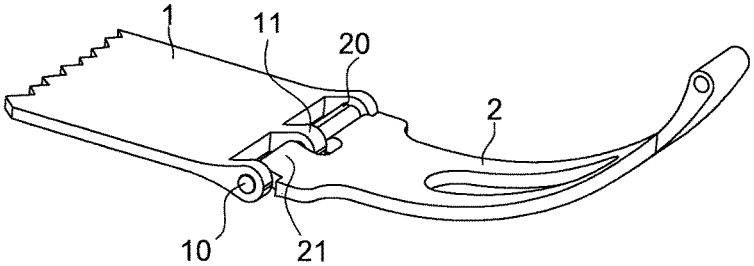

Initially, the first element 1 and the second element 2 are arranged perpendicularly to one another, as illustrated in FIG. 2*a*. The two elements 1 and 2 are then disposed perpendicularly one against the other so that the central element 10 rests in the space 22, as illustrated in FIG. 2*b*.

The user then causes one of the two elements to pivot in relation to the other around the central element 11, as visible in FIG. 2, until the bar 10 comes to sit in each of the grooves 20, 21.

A first element without a central element 11 surrounding the bar 10 is clearly also conceivable, wherein the central element 11 facilitates the positioning of the second element 2 and serving as reference for the rotation.

Because of these different aspects of the invention an attachment device is provided that enables two elements of a wristband to be attached and/or detached or a wristband to be attached/detached to a watch case quickly and easily without any special tools.

The present invention is, of course, not limited to the illustrated example and is open to different variants and modifications that would be evident to a person skilled in the art.

What is claimed is:

1. An attachment device for a watch band, the attachment device comprising:

a first element; and a second element, wherein the first element comprises at least one bar on one of its ends, wherein the second element comprises two fixed grooves, each comprising a longitudinal opening respectively opposite one another, and one of the two elements can move from an unhooked position in which one of the elements is oriented in a predetermined angular position in relation to the other element, to a hooked position in which the two elements are coplanar after a rotation of a predetermined angle of one of the two elements in relation to the other so that each groove is articulated on the bar to hold the two elements hooked to one another, and wherein the first element comprises a central element surrounding the bar.

2. The attachment device according to claim 1, wherein a dimension of the longitudinal opening of the grooves is slightly smaller than the bar.

3. The attachment device according to claim 1, wherein the grooves comprise a straight cylindrical slot, a diameter of which is slightly larger than a diameter of the bar.

4. The attachment device according to claim 1, wherein the second element comprises a free space arranged between the two grooves and arranged to receive said central element of the first element.

5. The attachment device according to claim 1, wherein the predetermined angular position is in the range of between 45° and 90°.

6. The attachment device according to claim 1, wherein the second element is made in a single block.

7. The attachment device according to claim 1, wherein the one of the two elements is rotated around the central bar to move between the unhooked position and the hooked position.

8. A watch band comprising:

a first band including a first element; and a second band including a second element, the first element and the second element allowing the first band and the second band to be hooked into place or unhooked, wherein one of the first band and the second band is a clasp, wherein the first element comprises at least one bar on one of its ends, and wherein the second element comprises two fixed grooves, each comprising a longitudinal opening respectively opposite one another, and one of the two elements can move from an unhooked position in which one of the elements is oriented in a predetermined angular position in relation to the other element, to a hooked position in which the two elements are coplanar after a rotation of a predetermined angle of one of the two elements in relation to the other so that each groove is articulated on the bar to hold the two elements hooked to one another.

9. The watch band according to claim 8, wherein a dimension of the longitudinal opening of the grooves is slightly smaller than the bar.

10. The watch band according to claim 8, wherein the grooves comprise a straight cylindrical slot, a diameter of which is slightly larger than a diameter of the bar.

11. The watch band according to claim 8, wherein the first element comprises a central element surrounding the bar.

12. The watch band according to claim 11, wherein the second element comprises a free space arranged between the two grooves and arranged to receive said central element of the first element.

13. The watch band according to claim 11, wherein the one of the two elements is rotated around the central bar to move between the unhooked position and the hooked position.

14. The watch band according to claim 8, wherein the predetermined angular position is in the range of between 45° and 90°.

15. The watch band according to claim 8, wherein the second element is made in a single block.

* * * * *